US008502622B2

(12) United States Patent
Hein et al.

(10) Patent No.: US 8,502,622 B2
(45) Date of Patent: Aug. 6, 2013

(54) APPARATUS AND METHODS FOR PHASE TUNING ADJUSTMENT OF SIGNALS

(75) Inventors: Paul W. Hein, McKinney, TX (US); Van V. Sayavongsa, Rockwall, TX (US); James D. Dowd, Greenville, TX (US)

(73) Assignee: L-3 Communications Integrated Systems L.P., Greenville, TX (US)

( * ) Notice: Subject to any disclaimer, the term of this patent is extended or adjusted under 35 U.S.C. 154(b) by 1622 days.

(21) Appl. No.: 12/005,416

(22) Filed: Dec. 26, 2007

(65) Prior Publication Data

US 2012/0235768 A1 Sep. 20, 2012

(51) Int. Cl.
*H01P 3/08* (2006.01)
*H01P 5/12* (2006.01)

(52) U.S. Cl.
USPC ..... 333/136; 333/238; 333/246

(58) Field of Classification Search
USPC ..... 333/136, 156, 161, 238, 246
See application file for complete search history.

(56) References Cited

U.S. PATENT DOCUMENTS 3,359,513 A * 12/1967 Kelley ..... 333/161
3,996,529 A 12/1976 Curtice
4,652,880 A 3/1987 Moeller et al.
5,107,232 A 4/1992 Evans
5,163,181 A 11/1992 Koontz
5,909,191 A 6/1999 Hirshfield et al.
6,967,543 B2 11/2005 Ammar
7,068,220 B2 6/2006 DeNatale et al.
7,205,937 B2 4/2007 Hein
2004/0080917 A1 4/2004 Steddom et al.

OTHER PUBLICATIONS

Winkler et al., "Flexible Picosecond Probing of Integrated Circuits With Chopped Electron Beams", IBM J. Res. Develop., vol. 34, No. 2/3, Mar./May 1990, 189-203 pgs.
Wikipedia, "Microstrip", Printed From Internet Dec. 19, 2007, 5 pgs.
Wikipedia, "Stripline", Printed From Internet Dec. 19, 2007, 2 pgs.
L-3 Communications, Search Report, PCT/US08/13784, Feb. 17, 2009, 2 pgs.

* cited by examiner

*Primary Examiner* — Robert Pascal
*Assistant Examiner* — Kimberly Glenn
(74) *Attorney, Agent, or Firm* — Egan, Peterman & Enders LLP

(57) ABSTRACT

Apparatus and methods for tuning the phase of a signal communicated by an electrical conductor by adjustably varying a spacing between the electrical conductor and at least a portion of an electrically conductive ground plane that is disposed in spaced relationship with the electrical conductor.

34 Claims, 7 Drawing Sheets

APPARATUS AND METHODS FOR PHASE TUNING ADJUSTMENT OF SIGNALS

This invention was made with United States Government support under Contract No. FA8620-06-G-4003. The Government has certain rights in this invention.

FIELD OF THE INVENTION

This invention relates generally to phase tuning, and more particularly, to phase tuning adjustment.

BACKGROUND OF THE INVENTION

Coaxial line stretchers or small wire filaments are conventionally used to tune the phase in a radio frequency ("RF") sub-assembly such as an individual transmission line of an apparatus such as RF power combiner or RF divider. For example, a power combiner, divider, or boresight RF distribution network may consist of multiple interconnected transmission line sub-assemblies that each has a RF signal phase error. The combined RF signal phase error of the interconnected sub-assemblies may result in an overall phase error that exceeds the allowable phase tolerance for the system, therefore requiring phase tuning of the individual sub-assemblies. However, adjustable coaxial line stretchers ("trombone" line stretchers) are expensive, require a relatively large amount of space, are non-hermetic, and can be tricky to adjust. Phase tuning operations using wire filaments is a labor intensive process that requires opening a RF cavity (where present), and then soldering and trimming of a thin wire to achieve phase adjustment. If not performed correctly the first time, this soldering and trimming process must be repeated.

SUMMARY OF THE INVENTION

Disclosed herein are apparatus and methods for tuning the phase of a signal, such as a RF or other type signal, communicated by an electrical conductor by adjustably varying a spacing between the electrical conductor and an electrically conductive ground plane that is disposed in spaced relationship with the electrical conductor. For example, in one embodiment additional phase delay may be gained by decreasing the ground plane spacing (e.g., in a small area relative to wavelength and between an electrical conductor trace and ground plane) in a microstrip transmission line, stripline, etc. The ground plane spacing may be so decreased, for example, by adjusting the depth of a conductive screw or other adjustable conductive member that is electrically coupled or grounded to the ground plane of a signal transmission circuit apparatus such as a microstrip transmission line or stripline apparatus.

Also disclosed herein are apparatus and methods for tuning the phase of a signal communicated by an electrical conductor by adjustably varying a spacing between the electrical conductor and an adjustable member composed of a material having a dielectric constant that is different than a dielectric constant of a fixed dielectric material that is disposed between the electrical conductor and an electrically conductive ground plane such that a phase delay of a signal communicated by the electrical conductor when the adjustable member is disposed at a first distance relative to the electrical conductor than a phase delay of the same signal communicated by the same electrical conductor when the adjustable member is disposed at a second distance relative to the electrical conductor that is different than the first distance.

The disclosed apparatus and methods may be employed in a variety of applications, and in one exemplary embodiment may be implemented to correct phase errors by tuning the phase delay of at least one RF sub-assembly such as an individual transmission line of a RF power combiner of a RF distribution network that includes multiple interconnected transmission line sub-assemblies. In such an embodiment, phase delay of one or more of the multiple individual interconnected transmission line sub-assemblies may be varied to reduce a RF signal phase error of the individual transmission line sub-assembly, e.g., such that the combined root mean square (RMS) RF signal phase error of the interconnected sub-assemblies results in an overall phase error that is within the allowable phase tolerance for the system.

The disclosed apparatus and methods may be implemented in one exemplary embodiment using an apparatus that is relative inexpensive, relatively simple and non-labor intensive to install in a production environment (e.g., for microstrip circuits, stripline circuits, etc.), relatively easy to operate, and that is space efficient. In this regard, space efficiency may be achieved by adjustably varying a spacing between the electrical conductor (e.g., microstrip transmission line or stripline) and an electrically conductive ground plane in a non-inline manner such that the length of the electrical conductor is not affected or required to be longer.

Examples of other advantages that may be optionally realized in various embodiments of the disclosed apparatus and methods include, but are not limited to, the flexibility to provide for adjustment of a signal phase anywhere on a microstrip or stripline board, the ability to provide for fine tuning of a signal phase by turning a screw or other type of provided adjustable member, the ability to provide for adjustment of a signal phase at multiple places in a design, the ability to provide for increasing the amount of phase tuning by adding more adjustable members (e.g., screws and openings for receiving the same), the ability to provide for phase tuning with relatively small impact on insertion loss and/or on voltage standing wave ratio (VSWR), the ability to provide a signal transmission circuit apparatus that may be made hermetic, e.g., by using a sealant or solder applied to an adjustable member (e.g., screw and nut) after phase adjustment has been made.

In one respect, disclosed herein is a signal distribution network apparatus, including: at least one electrically conductive ground plane; a dielectric material disposed adjacent the at least one electrically conductive ground plane; two or more electrical conductors disposed in spaced relationship to the at least one electrically conductive ground plane with the dielectric material disposed therebetween, each of the two or more electrical conductors having a signal input and a signal output, each given one of the two or more electrical conductors being disposed in spaced relationship to the at least one electrically conductive ground plane at a position between the signal input and the signal output of the given one of the two or more electrical conductors; and at least one adjustable conductive member corresponding to each given one of the two or more electrical conductors, each of the at least one adjustable conductive members being disposed adjacent the corresponding given one of the two or more electrical conductors at a point between the signal input and the signal output of the two or more electrical conductors, and disposed closer to a corresponding given one of the two or more electrical conductors than it is disposed to any other of the two or more electrical conductors. Each of the at least one adjustable conductive members may be disposed in electrical contact with the at least one electrically conductive ground plane, and each of the at least one adjustable conductive members may be configured to be adjustable between at least two positions that are each spaced apart from the corresponding given one of the two or more electrical conductors, the at least one adjustable conductive member being closer in distance to the corresponding given one of the electrical conductors when disposed in a first one of the at least two positions than when disposed in a second one of the at least two positions. A phase delay of a signal communicated by each given one of the two or more electrical conductors when the at least one adjustable conductive member corresponding to the given one of the two or more electrical conductors is disposed in the first one of the at least two positions is different than a phase delay of the same signal communicated by the same given one of the two or more electrical conductors when the at least one adjustable conductive member corresponding to the given one of the two or more electrical conductors is disposed in the second one of the at least two positions. The signal outputs of the two or more electrical conductors may be electrically coupled together to combine signals communicated by the two or more electrical conductors, or the respective signal inputs of the two or more electrical conductors may be electrically coupled together to divide an incoming signal into a first signal provided at the input of the first one of the two or more electrical conductors and a second signal provided at the input of the second one of the two or more electrical conductors.

In another respect, disclosed is a method of combining signals in a signal distribution network apparatus, including providing a signal distribution network apparatus that includes: at least one electrically conductive ground plane, a dielectric material disposed adjacent the at least one electrically conductive ground plane, two or more electrical conductors disposed in spaced relationship to the at least one electrically conductive ground plane with the dielectric material disposed therebetween, each of the two or more electrical conductors having a signal input and a signal output, each given one of the two or more electrical conductors being disposed in spaced relationship to the at least one electrically conductive ground plane at a position between the signal input and the signal output of the given one of the two or more electrical conductors, at least one first adjustable conductive member corresponding to a first one of the two or more electrical conductors, the at least one first adjustable conductive member being disposed adjacent the first one of the two or more electrical conductors at a point between the signal input and the signal output of the first one of the two or more electrical conductors and being disposed closer to the first one of the two or more electrical conductors than it is disposed to any other of the two or more electrical conductors, and at least one second adjustable conductive member corresponding to a second one of the two or more electrical conductors, the at least one second adjustable conductive member being disposed adjacent the second one of the two or more electrical conductors at a point between the signal input and the signal output of the second one of the two or more electrical conductors and being disposed closer to the second one of the two or more electrical conductors than it is disposed to any other of the two or more electrical conductors. Each of the at least one adjustable conductive members may be disposed in electrical contact with the at least one electrically conductive ground plane, and the method may further include: providing a first signal at an input of the first one of the two or more electrical conductors such that the first signal is communicated through the first one of the two or more electrical conductors to an output of the second of the two or more electrical conductors; providing a second signal at an input of a second one of the two or more electrical conductors such that the second signal is communicated through the second one of the two or more electrical conductors to an output of the second of the two or more electrical conductors; adjusting the at least one first adjustable conductive member between at least two positions that are each spaced apart from the first one of the two or more electrical conductors while the first signal is being communicated through the first electrical conductor, the at least one first adjustable conductive member being closer in distance to the first one of the two or more electrical conductors when disposed in a first one of the at least two positions than when disposed in a second one of the at least two positions, and such that a phase delay of the first signal being communicated by the first one of the two or more electrical conductors when the at least one first adjustable conductive member is disposed in the first one of the at least two positions is different than a phase delay of the first signal when the at least one first adjustable conductive member is disposed in the second one of the at least two positions; adjusting the at least one second adjustable conductive member between at least two positions that are each spaced apart from the second one of the two or more electrical conductors while the second signal is being communicated through the second electrical conductor, the at least one second adjustable conductive member being closer in distance to the second one of the two or more electrical conductors when disposed in a first one of the at least two positions than when disposed in a second one of the at least two positions, and such that a phase delay of the second signal being communicated by the second one of the two or more electrical conductors when the at least one second adjustable conductive member is disposed in the first one of the at least two positions is different than a phase delay of the second signal when the at least one second adjustable conductive member is disposed in the second one of the at least two positions; and combining the first signal received from the output of the first one of the two or more electrical conductors with the second signal received from the second one of the two or more electrical conductors, or dividing an incoming signal into the first and second signals prior to providing the first signal at the input of the first one of the two or more electrical conductors and prior to providing the second signal at the input of the second one of the two or more electrical conductors.

In another respect, disclosed herein is a signal transmission circuit apparatus, including: a first electrically conductive ground plane; a dielectric material disposed adjacent the first electrically conductive ground plane; and an electrical conductor disposed in spaced relationship to the first electrically conductive ground plane with the dielectric material disposed therebetween. A spacing between the electrical conductor and at least a portion of the first electrically conductive ground plane may be adjustable to vary the phase delay of a signal communicated by the electrical conductor.

In another respect, disclosed herein is a method of adjusting a phase delay of a signal, including providing a signal transmission circuit apparatus that includes: at least one electrically conductive ground plane, a dielectric material disposed adjacent the at least one electrically conductive ground plane, and an electrical conductor disposed in spaced relationship to the at least one electrically conductive ground plane with the dielectric material disposed therebetween, the electrical conductor having a signal input and a signal output, and the electrical conductor being disposed in spaced relationship to the at least one electrically conductive ground plane at a position between the signal input and the signal output, wherein a spacing between the electrical conductor and at least a portion of the at least one electrically conductive ground plane is adjustable. The method may also include: providing a signal at the input of the electrical conductor such that the signal is communicated through the electrical conductor to the output of the electrical conductor; and adjusting a spacing between the electrical conductor and at least a portion of the first electrically conductive ground plane to vary the phase delay of the signal communicated by the electrical conductor.

In another respect, disclosed herein is a signal transmission circuit apparatus, including: a first electrically conductive ground plane; a dielectric material disposed adjacent the first electrically conductive ground plane; an electrical conductor disposed in spaced relationship to the first electrically conductive ground plane with the dielectric material disposed therebetween; and at least one adjustable member configured to be adjustable between at least two positions that are each spaced apart from the electrical conductor, the at least one adjustable member being closer in distance to the electrical conductor when disposed in a first one of the at least two positions than when disposed in a second one of the at least two positions. The adjustable member may include a material effective to vary an electromagnetic field of a signal communicated by the electrical conductor when the at least one adjustable member is disposed in the first one of the at least two positions such that a phase delay of the signal communicated by the electrical conductor when the at least one adjustable member is disposed in the first one of the at least two positions is different than a phase delay of the same signal communicated by the electrical conductor when the at least one adjustable member is disposed in the second one of the at least two positions.

In another respect, disclosed herein is a method of adjusting a phase delay of a signal, including providing a signal transmission circuit apparatus that includes: at least one electrically conductive ground plane, a dielectric material disposed adjacent the at least one electrically conductive ground plane, an electrical conductor disposed in spaced relationship to the at least one electrically conductive ground plane with the dielectric material disposed therebetween, the electrical conductor having a signal input and a signal output, and the electrical conductor being disposed in spaced relationship to the at least one electrically conductive ground plane at a position between the signal input and the signal output, and at least one adjustable member in electrical contact with the at least one electrically conductive ground plane and being disposed adjacent the electrical conductor at a point between the signal input and the signal output of the electrical conductor, the adjustable member including a material effective to vary an electromagnetic field of a signal communicated by the electrical conductor when disposed adjacent the electrical conductor. The method may also include: providing a signal at the input of the electrical conductor such that the signal is communicated through the electrical conductor to the output of the electrical conductor; and adjusting the adjustable member between at least two positions that are each spaced apart from the electrical conductor while the signal is being communicated through the electrical conductor to vary an electromagnetic field of the signal communicated by the electrical conductor, the at least one adjustable member being closer in distance to the electrical conductor when disposed in a first one of the at least two positions than when disposed in a second one of the at least two positions, and such that a phase delay of the signal being communicated by the electrical conductor when the at least one adjustable member is disposed in the first one of the at least two positions is different than a phase delay of the signal when the at least one adjustable member is disposed in the second one of the at least two positions.

DESCRIPTION OF ILLUSTRATIVE EMBODIMENTS

Figure 1A:
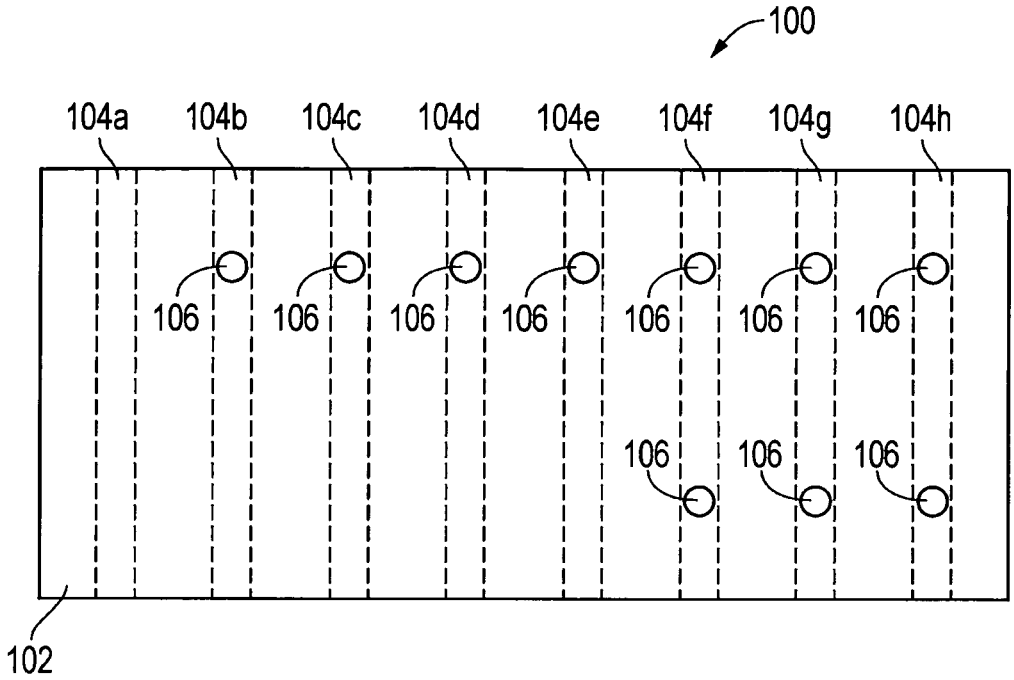
FIG. 1A is a bottom view of a RF signal transmission circuit apparatus according to one exemplary embodiment of the disclosed apparatus and methods.
Figure 1B:
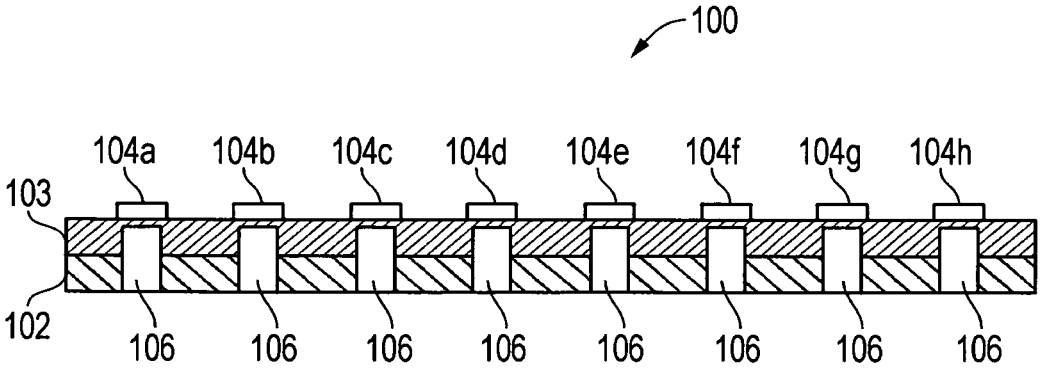
FIG. 1B is a side cross-sectional view of a RF signal transmission circuit apparatus according to one exemplary embodiment of the disclosed apparatus and methods.

FIG. 1A and 1B are bottom view and cross-sectional side view, respectively, of a RF signal transmission circuit apparatus 100 according to one exemplary embodiment of the disclosed apparatus and methods. As shown in FIGS. 1A and 1B, RF signal transmission circuit apparatus 100 includes a substantially planar electrically conductive ground plane 102 and a substantially planar dielectric material 103 having a lower side disposed adjacent an upper side of the electrically conductive ground plane 102. In this exemplary embodiment, multiple elongated electrical conductors are present as exposed microstrip transmission lines 104*a* through 104*h* on upper exposed surface of the upper side of dielectric material 103 so that transmission lines 104*a* through 104*h* are disposed in spaced relationship to electrically conductive ground plane 102 with dielectric material 103 disposed therebetween. It will be understood that although the illustrated RF signal transmission circuit apparatus 100 is configured with multiple electrical conductors in the form of multiple parallel-oriented microstrip transmission lines 104*a* through 104*h*, that an RF signal transmission circuitry apparatus may be alternatively provided with any other number (i.e., one or more, two or more, three or more, etc.) and configuration (e.g., planar RF design such as a power divider, filter, coupler, etc.) of electrical conductors disposed in spaced relationship to an electrically conductive ground plane with dielectric material therebetween.

Still referring to FIGS. 1A and 1B, substantially planar electrically conductive ground plane 102 may be composed of any electrically conductive material that is suitable for use as a ground plane component relative to electrical conductor circuitry (e.g., microstrip transmission line circuitry 104*a* through 104*h*) disposed on dielectric material 103. Examples of suitable ground plane materials include, but are not limited to, copper, aluminum, etc. Dielectric material 103 may be any dielectric material that is suitable for separating and electrically insulating electrical conductor circuitry (e.g., microstrip transmission line circuitry 104*a* through 104*h*) from electrically conductive ground plane 102. Examples of suitable dielectric materials include, but are not limited to, printed circuit board (PCB) materials (e.g., Flame Retardant 4 (FR4) material), polytetrafluoroethylene (PTFE), TEFLON, ceramic, combinations thereof, etc. Electrical conductor circuitry may be of any suitable geometry and/or configuration, (stripline, microstrip, co-planar, etc.) and/or of conductive material (e.g., copper, aluminum, gold, silver, tin, nickel, etc.) suitable for forming electrical conductors for communicating RF signals relative to electrically conductive ground plane 102.

Still referring to FIGS. 1A and 1B, openings 106 are provided that extend through electrically conductive ground plane 102 and into dielectric material 103 in a position adjacent one of multiple parallel-oriented microstrip transmission lines 104*b* through 104*h* as shown. As shown, each of openings 106 are disposed adjacent and substantially centered along a longitudinal axis of one or elongated microstrip transmission lines 104. In the illustrated exemplary embodiment, openings 106 do not extend completely through dielectric material 103 to microstrip transmission lines 104, although in other embodiments it is possible that openings 106 may extend completely through dielectric material 103 to microstrip transmission lines 104. In one exemplary embodiment, an opening 106 may extend into dielectric material 103 such that about 1/500 inch thickness of dielectric material is left between the opening 106 and a respective microstrip transmission line 106 which may be, for example, a 1/1000 inch thick copper foil strip.

Figure 2:
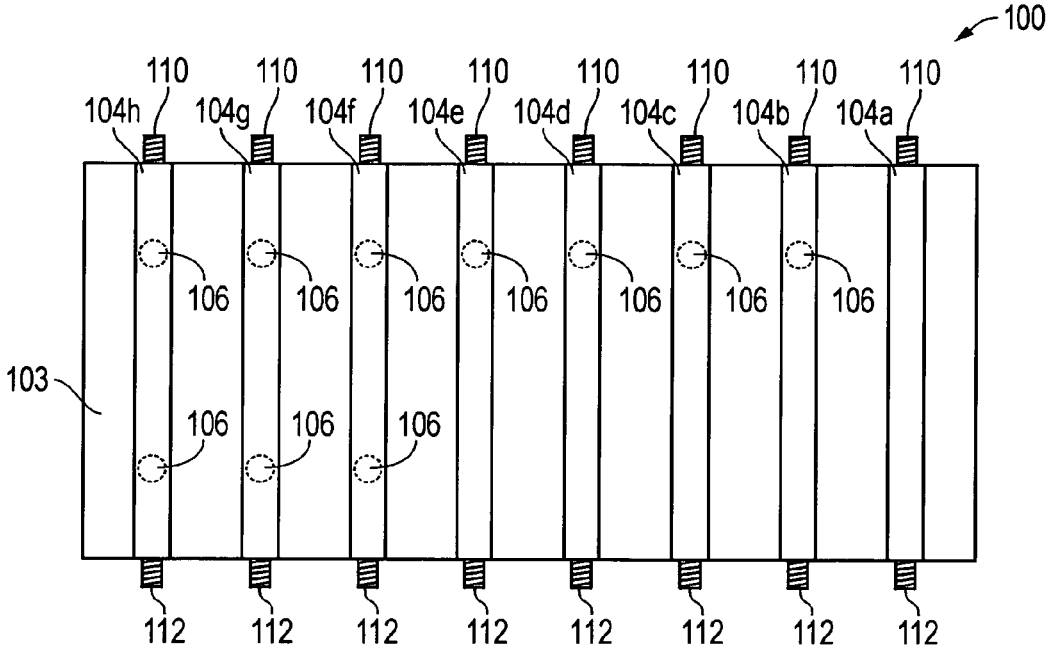
FIG. 2 is a top view of a RF signal transmission circuit apparatus according to one exemplary embodiment of the disclosed apparatus and methods.

FIG. 2 is a top view of RF signal transmission circuit apparatus 100 showing each of microstrip transmission lines 104*a* through 104*h* being provided with a signal input in the form of a RF connector 110 (e.g., SMA or other suitable connector) and a signal output in the form of a RF connector 112. As will be further described herein, each microstrip transmission line signal input 110 may be coupled to receive a RF signal from, for example, a separate RF antenna apparatus. Alternatively, each microstrip transmission line signal input 110 may be coupled to receive a separate RF signal provided by a power divider that is coupled between each microstrip transmission line 104 and a common antenna apparatus. However, it will be understood that a RF signal may be provided from any other suitable source or combination of RF signal sources. A signal output 112 of a given microstrip transmission line 104 may be coupled to signal processing circuitry (e.g., digital signal processor, etc.) for further processing.

In another possible implementation, one or more electrical conductors (e.g., microstrip or stripline transmission lines) of a RF signal transmission circuit apparatus of the disclosed apparatus and methods may be coupled together and employed as respective transmission line delay elements of a phase shifting device of U.S. Pat. No. 7,205,937, which is incorporated herein by reference in its entirety. For example, phase delay imparted to a signal by a given one or more electrical conductors of the disclosed signal transmission circuit apparatus may be adjusted to vary the value of the magnitude of phase shift imparted to the signal by the given electrical conductor to be a non-multiple delay element value.

Although FIGS. 1A and 1B are described herein in relation to a RF signal transmission circuit apparatus, it will be understood that as with the phase shifting device of U.S. Pat. No. 7,205,937, the disclosed systems and methods may be implemented, for example, with phased array antenna systems, with any other type of antenna system having multiple antenna elements, or with any other type of apparatus or system employed to phase shift a signal or to phase shift multiple signals relative to each other (e.g., apparatus or system having multiple phased array elements). In this regard, the disclosed systems and methods may be implemented with any apparatus configured to receive, transmit, or otherwise process signals of any frequency or frequency range suitable for propagation through a variety of media including, but not limited to, gaseous medium (e.g., air), solid medium (e.g., earth, tissue), vacuum, etc. Examples of such signals include, but are not limited to, radio frequency signals, radar signals, sonar signals, seismic signals, ultrasonic signals, etc.

Examples of types of apparatus and systems that may be implemented with the disclosed systems and methods include, but are not limited to, phased array radio frequency (RF) antennas or beamformers, sonar arrays (for transmitting/receiving acoustic signals), ultrasonic arrays (ultrasonic signals for medical and flaw analysis imaging purposes), radar arrays (e.g., for bi-static and mono-static radar), mobile and land based telecommunications devices, seismic arrays, etc. Examples of specific types of phased array RF antennas that may be implemented with the disclosed systems and methods include, but are not limited to, narrow band phased array antennas, broad band phased array antennas, etc. In one embodiment, the disclosed systems and methods may be implemented at any RF frequencies where phased array antennas may be employed (e.g., HF band, KA band, M band, etc.) In another exemplary embodiment, the disclosed systems and methods may be employed in surveillance applications (e.g., airborne, ship-based, space-based, submarine based, etc.) including, but not limited to, as a part of a tactical reconnaissance system.

Figure 3:
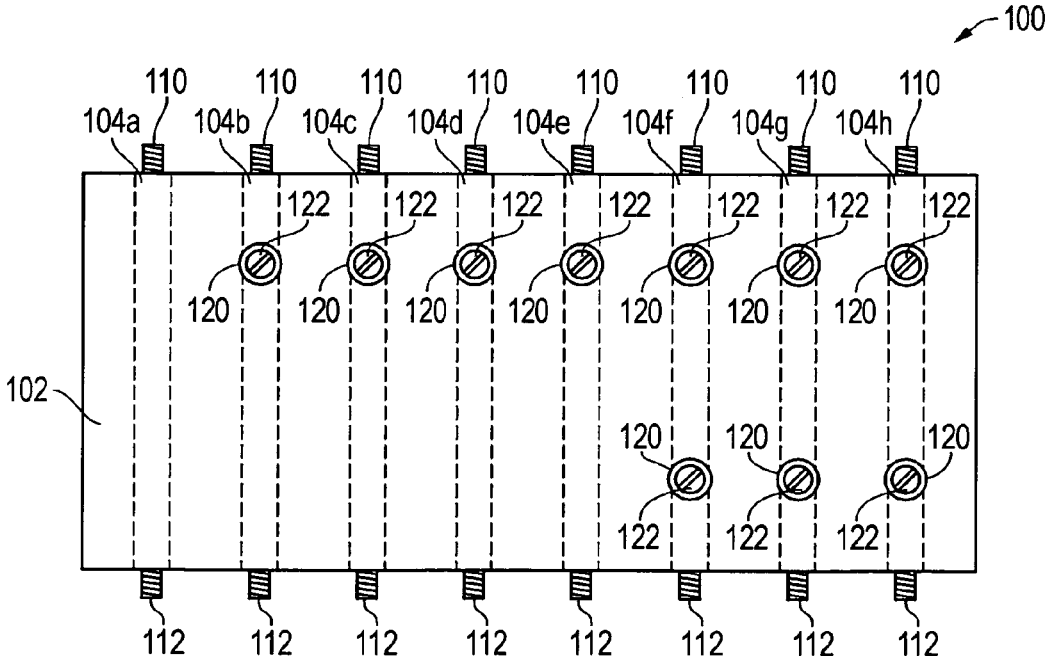
FIG. 3 is a bottom view of a RF signal transmission circuit apparatus according to one exemplary embodiment of the disclosed apparatus and methods.
Figure 4:
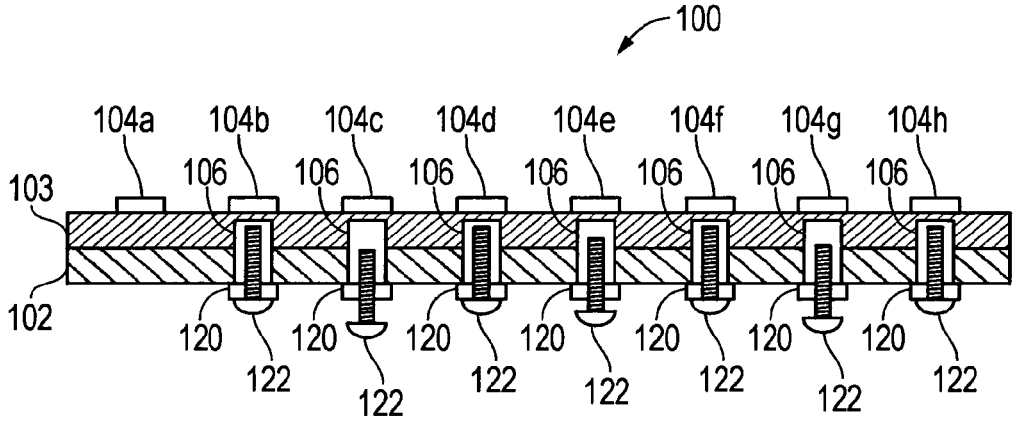
FIG. 4 is a side cross-sectional view of a RF signal transmission circuit apparatus according to one exemplary embodiment of the disclosed apparatus and methods.

As further shown in the exemplary embodiment of FIGS. 3 and 4, openings 106 are each provided with an electrically conductive internally threaded stand-off or collar 120 to receive a corresponding adjustable conductive member provided in the form of a threaded screw 122 that is complementary threaded to match the internal threads of threaded collar 120. Electrically conductive internally threaded collar 120 may be soldered or otherwise conductively attached to conductive ground plane 102. In this embodiment, each of threaded screws 122 is of a length sufficient to extend through a corresponding internally threaded collar 120 into a corresponding opening 160 to a depth that is adjustable by rotation of the threaded screw 122 within threaded collar 120. In this way, each of threaded screws 122 is adjustable between multiple positions of varying distance from a corresponding microstrip transmission line 104, including distances that are closer to its corresponding microstrip transmission line 104 than is electrically conductive ground plane 102 as shown in FIG. 4. In such a configuration, each microstrip transmission line 104 and its corresponding adjustable conductive screw 122 together form a phase tuner.

Although threaded screws 122 are illustrated received in corresponding internally threaded collars 120, any other configuration may be employed that is suitable for providing a conductive member that is electrically coupled to a ground plane and that is adjustable to a position closer to a corresponding electrical conductor than is the remainder of the ground plane. For example, internally threaded nuts may be substituted for internally threaded collars 120, or an opening 106 may itself be internally threaded to receive a corresponding threaded screw 122 (i.e., without a threaded collar 120). In another embodiment, a non-threaded adjustable conductive member may be slidably received in a corresponding opening 106 to allow adjustment to a position between a ground plane 102 and a corresponding electrical conductor. In such an embodiment, a non-threaded adjustable conductive member may be frictionally received within an opening 106 (e.g., by conductive rubber bushing) to fix it in position, may be fixed in position by set screw, etc. In yet another embodiment, motorized or other automated mechanism may be configured to provide automatic adjustment (e.g., dynamic adjustment in real time) of the distance between an adjustable conductive member and a corresponding electrical conductor. It is also possible that an adjustable conductive member may be fixed in place after adjustment using a sealant and/or adhesive (e.g., epoxy, etc.)

Because each of conductive threaded screws 122 is electrically coupled to electrically conductive ground plane 102 via a conductive threaded collar 120, a conductive threaded screw 122 may be adjusted to effectively position a portion of conductive ground plane 102 closer to a corresponding microstrip transmission line 104 than is the remainder of conductive ground plane 102, as illustrated by positions of conductive threaded screws 104*b*-104*f* and 104*h* in FIG. 4. In this regard, a phase delay of a RF signal communicated by an electrical conductor such as one of microstrip transmission lines 104, is increased when a corresponding adjustable conductive member such as one of conductive threaded screws 122 is brought closer to the electrical conductor than is the ground plane 102.

As further illustrated in FIGS. 1-4, multiple (i.e., in this case two) adjustable conductive members may be disposed adjacent a given electrical conductor, in which case the effect on phase delay of a RF signal communicated by the electrical conductor is increased further when more than one adjustable conductive members is brought closer to the electrical conductor than is the ground plane. In this regard, the same phase delay value may be achieved with lower insertion loss using a greater number of adjustable conductive members brought close to a given electrical conductor than may be achieved with a single adjustable conductive member (or a smaller number of adjustable conductive members) brought close to the same given electrical conductor. It will be understood that a finer pitch of the threads of conductive threaded screws 122 and complementary conductive threaded collar 120 allows for a finer adjustment of phase delay of a RF signal communicated by a corresponding electrical conductor. Furthermore, it is possible that any other desired number of adjustable conductive members may be similarly disposed adjacent a given electrical conductor, e.g., three or more adjustable conductive members, four or more adjustable conductive members, etc.

Figure 5:
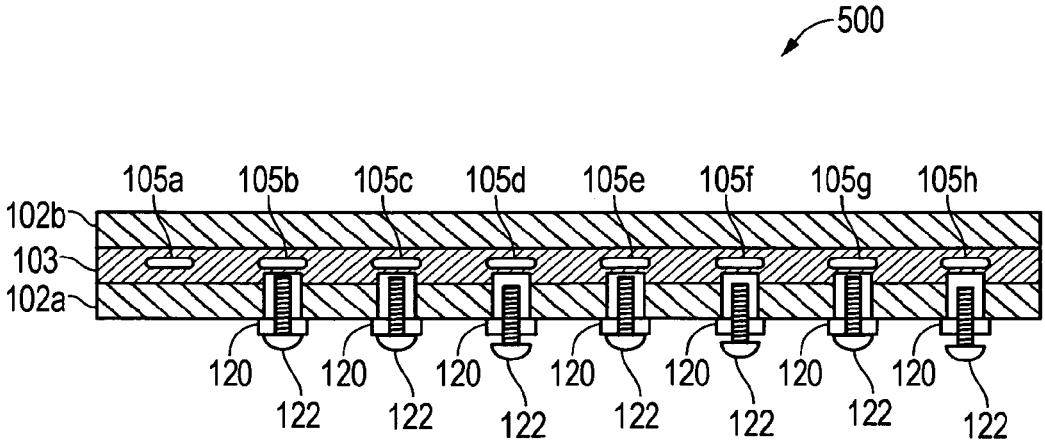
FIG. 5 is a side cross-sectional view of a RF signal transmission circuit apparatus according to one exemplary embodiment of the disclosed apparatus and methods.

FIG. 5 is a cross-sectional side view of a RF signal transmission circuit apparatus 500 according to another exemplary embodiment of the disclosed apparatus and methods. As shown in FIG. 5, RF signal transmission circuit apparatus 500 includes a first substantially planar electrically conductive ground plane 102*a* and a second substantially planar electrically conductive ground plane 102*b* with a substantially planar dielectric material 103 disposed therebetween. In this exemplary embodiment, multiple elongated electrical conductors are present as stripline transmission lines 105*a*through 105*h* that are embedded within dielectric material 103 so that transmission lines 104*a* through 104*h* are disposed in spaced relationship to each of electrically conductive ground planes 102*a* and 102*b* with dielectric material 103 disposed therebetween. Stripline transmission lines 105*a* through 105*h* of the embodiment of FIG. 5 are provided in the form of multiple parallel-oriented longitudinal stripline transmission lines 105*a* through 105*h* that each has a signal input (e.g., in the form of a RF connector) at one end and a signal output (e.g., in the form of a RF connector) at the opposite end. In the illustration of FIG. 5, the longitudinal axis of each of stripline transmission lines 105*a* through 105*h* is shown oriented perpendicular to, and extending into, the page.

Still referring to FIG. 5, openings 106 are provided that extend through electrically conductive ground plane 102*a* and into dielectric material 103 in a position adjacent one of multiple parallel-oriented stripline transmission lines 105*a* through 105*h* as shown. As shown, each of openings 106 are disposed adjacent and substantially centered along a longitudinal axis of one or elongated stripline transmission lines 105. In the illustrated exemplary embodiment, openings 106 do not extend completely through dielectric material 103 to stripline transmission lines 105, although in other embodiments it is possible that openings 106 may extend completely through dielectric material 103 to stripline transmission lines 105. Depth of openings 106 and thickness and materials of stripline transmission lines 105 may be, for example, similar to that of the microstrip transmission line embodiment of FIGS. 1-4.

Similar to the embodiment of FIG. 4, openings 106 of FIG. 5 are each provided with an electrically conductive internally threaded collar 120 to receive a corresponding adjustable conductive member provided in the form of a threaded screw 122 that is complementary threaded to match the internal threads of threaded collar 120. As with the embodiment of FIG. 4, each of threaded screws 122 is adjustable between multiple positions of varying distance from a corresponding stripline transmission line 105, including distances that are closer to its corresponding stripline transmission line 105 than is electrically conductive ground plane 102 as shown in FIG. 4.

Figure 6:
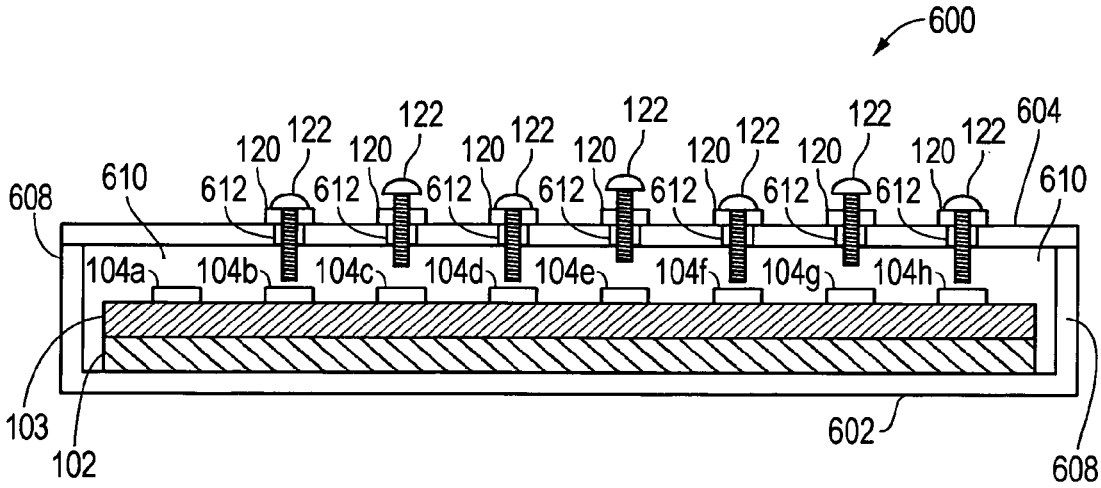
FIG. 6 is a side cross-sectional view of a RF signal transmission circuit apparatus according to one exemplary embodiment of the disclosed apparatus and methods.

FIG. 6 is a cross-sectional side view of a RF signal transmission circuit apparatus 600 according to yet another exemplary embodiment of the disclosed apparatus and methods. As shown in FIG. 6, RF signal transmission circuit apparatus 600 includes a substantially planar electrically conductive ground plane 102 and a substantially planar dielectric material 103 having a lower side disposed adjacent an upper side of the electrically conductive ground plane 102. Similar to the embodiment of FIGS. 1-4, multiple elongated electrical conductors are present in this exemplary embodiment as exposed microstrip transmission lines 104*a* through 104*h* on upper exposed surface of the upper side of dielectric material 103 so that transmission lines 104*a* through 104*h* are disposed in spaced relationship to electrically conductive ground plane 102 with dielectric material 103 disposed therebetween. Also, similar to the embodiment of FIGS. 1-4, microstrip transmission lines 104*a* through 104*h* of the embodiment of FIG. 6 are provided in the form of multiple parallel-oriented longitudinal microstrip transmission lines 104*a* through 104*h* that each has a signal input (e.g., in the form of a RF connector) at one end and a signal output (e.g., in the form of a RF connector) at the opposite end. In the illustration of FIG. 6, the longitudinal axis of each of microstrip transmission lines 104*a* through 104*h* is oriented perpendicular to, and extending into, the page.

Still referring to FIG. 6, a conductive enclosure (e.g., aluminum, steel, etc.) is provided to at least partially surround first electrically conductive ground plane 102, dielectric material 103 and microstrip transmission lines 104. As shown, the conductive enclosure of FIG. 6 includes an electrically conductive base component 602 that is in electrical contact (e.g., soldered, attached with fasteners such as screws, etc.) with the lower side of electrically conductive ground plane 102 and an electrically conductive lid component 604 disposed in spaced relationship with the upper side of the dielectric material 103 to form a cavity 610 therebetween. Also shown are electrically conductive side components 608 extending between electrically conductive base component 602 and electrically conductive lid component 604, with each of electrically conductive side components 602 being in electrical contact with electrically conductive base component 602 and electrically conductive lid component 604.

In the embodiment of FIG. 6, openings 612 are provided that extend through electrically conductive lid component 604 and into cavity 610 in a position adjacent one of multiple parallel-oriented microstrip transmission lines 104*b* through 104*h* as shown. As shown, each of openings 612 are disposed adjacent and substantially centered along a longitudinal axis of one or elongated microstrip transmission lines 104. Each of the openings 612 is provided with an electrically conductive internally threaded collar 120 to receive a corresponding adjustable conductive member provided in the form of a threaded screw 122 that is complementary threaded to match the internal threads of threaded collar 120. As with previously-described embodiments, each of threaded screws 122 is adjustable between multiple positions of varying distance from a corresponding microstrip transmission line 104, including distances that are closer to its corresponding microstrip transmission line 104 than is electrically conductive ground plane 102 to the same corresponding microstrip transmission line 104.

Figure 7:
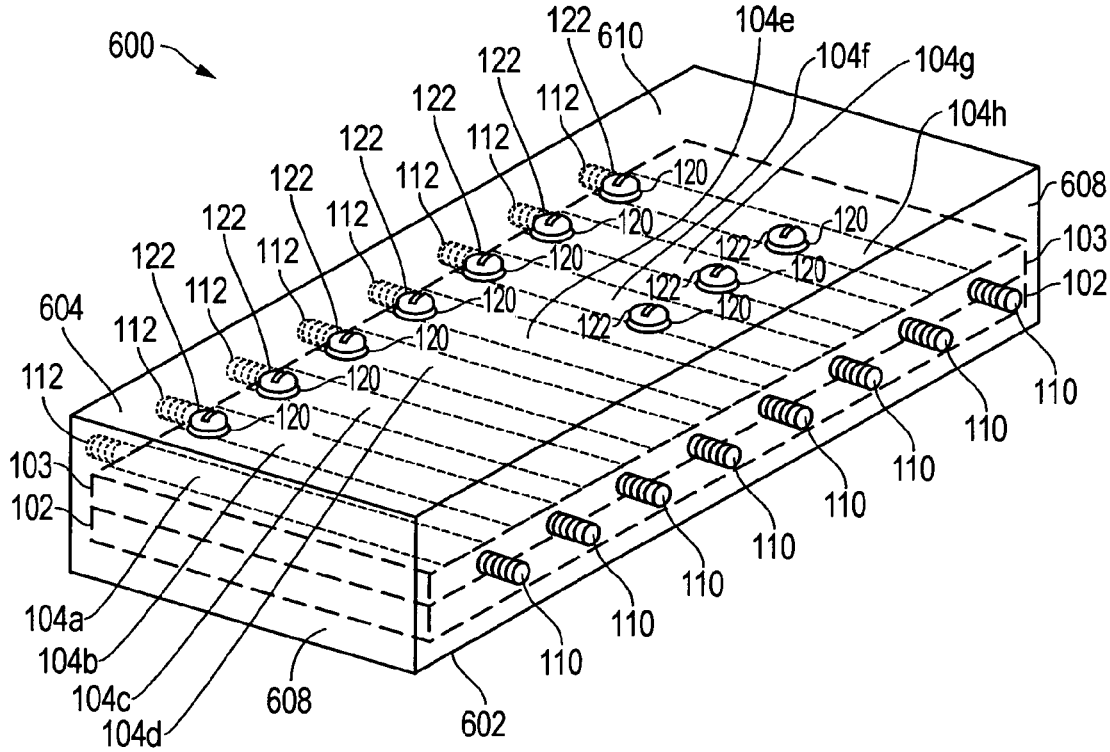
FIG. 7 is a perspective view of a RF signal transmission circuit apparatus according to one exemplary embodiment of the disclosed apparatus and methods.

FIG. 7 illustrates a perspective view of RF signal transmission circuit apparatus 600 showing how electrically conductive side components 608, electrically conductive base component 602 and electrically conductive lid component 604 together may form a conductive enclosure that may be hermetically sealed in one exemplary embodiment, i.e., so that cavity 610 provides a hermetically sealed environment for microstrip transmission lines 104, it being understood that although FIG. 7 illustrates a box-like conductive enclosure that other configurations are possible. To form a hermetically sealed conductive enclosure, adjustable conductive members (e.g., threaded screws 122) may be sealed to a corresponding conductive enclosure in any suitable fashion, e.g., silicone sealant, solder, etc. In one exemplary embodiment, adjustable conductive members may be sealed to a corresponding conductive enclosure after adjustment. In any case, such a hermetically sealed RF signal transmission circuit apparatus enclosure may be advantageously utilized, for example, in an unpressurized pod (e.g., "cheek" pod) of an aircraft having internal cavity that is exposed to outside temperature, moisture and pressure conditions under airborne operations, and large changes in those conditions between ground level and high altitude operations. In one exemplary embodiment, such a hermetically sealed RF signal transmission circuit apparatus enclosure may be configured, for example, to pass a gross leak test (MIL-STD-883, method 1014, test condition C) or a fine leak test (MIL-STD-883, method 1014, test condition A1).

As further shown in FIG. 7, each of microstrip transmission lines 104*a* through 104*h* is provided with a signal input in the form of a RF connector 110 extending through a conductive side component 608 and a signal output in the form of a RF connector 112 extending through another conductive side component, e.g., so that each microstrip transmission line signal input 110 within the conductive enclosure of FIGS. 6-7 may be coupled to receive a RF signal from, for example, a separate RF antenna apparatus or from a power divider.

It will be understood that a conductive enclosure such as illustrated in FIGS. 6-7 may be alternatively provided to at least partially surround a stripline transmission line apparatus such as illustrated in FIG. 5, in which case adjustable conductive members 122 that are received in openings 612 of electrically conductive lid component 604 may be adjustable between multiple positions of varying distance from a corresponding stripline transmission line 105 by extending through electrically conductive ground plane 102*a* and into dielectric material 103 in a position adjacent the stripline transmission line 105.

Figure 8A:
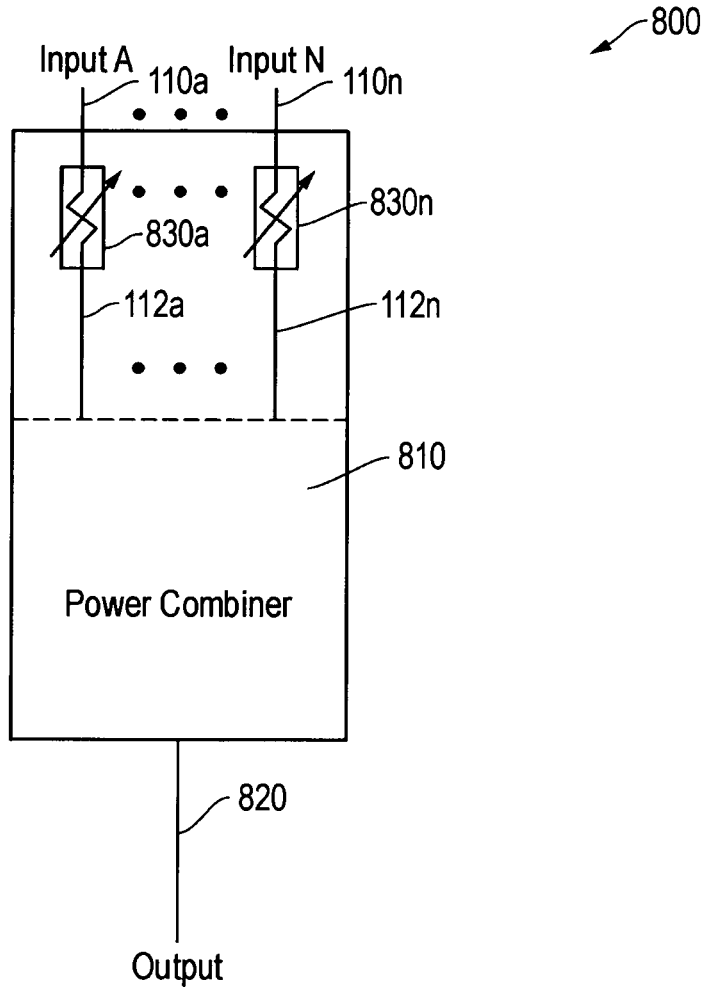
FIG. 8A is a simplified block diagram of a RF signal distribution network apparatus according to one exemplary embodiment of the disclosed apparatus and methods.

It will be understood however, that a conductive enclosure need not be hermetically sealed in other embodiments, and that a conductive enclosure may be of other configurations and shapes, e.g., non-rectangular shapes such as circular, oval, etc. It will also be understood that a conductive enclosure may be formed from any one or more conductive components, and that it is not necessary that there be a separate lid, base and side components as provided in the embodiment of FIGS. 6-7. Furthermore, although a conductive enclosure may be provided in one embodiment that encloses electrical conductors of a RF signal transmission circuit apparatus, it will be understood that in other embodiments it is not necessary that electrical conductors (e.g., microstrip transmission lines 104 or stripline transmission lines 105) of a RF signal transmission circuit apparatus be enclosed, e.g., at least one conductive side component provided on less than all sides of a RF signal transmission circuit apparatus may be provided to support a conductive lid component at least partially over one or more electrical conductors and that is suitably configured to support one or more adjustable conductive members (e.g., such as threaded screws 122 threadably received in threaded collars 120) in a position so that each adjustable conductive member is configured to adjustably extend from the electrically conductive lid component toward at least one electrical conductor from a second one to a first one of at least two positions relative to the electrical conductor FIG. 8A is a block diagram of a RF signal distribution network apparatus 800 according to one exemplary embodiment that includes two or more phase tuners 830*a* through 830*n* that each include an electrical conductor (e.g., microstrip transmission line 104 or stripline transmission line 105) disposed in spaced relationship to an electrically conductive ground plane with dielectric material disposed therebetween and with a spacing between the electrical conductor and at least a portion of the electrically conductive ground plane being adjustable to vary the phase delay of a RF signal communicated by the electrical conductor in a manner as described elsewhere herein, e.g., such as in relation to the embodiments of FIGS. 1-7. As shown in FIG. 8A, RF signal distribution network apparatus 800 includes a separate RF signal input 110 corresponding to each of phase tuners 830, and each of phase tuners 830 in turn includes a respective RF signal output 112. Each of RF signal inputs 110 may be coupled to receive a RF signal, e.g., from a separate respective RF antenna apparatus, or from a power divider that is coupled between each RF signal input 110 and a common antenna apparatus. As shown, RF signal distribution network apparatus 800 further includes power combiner circuitry (e.g., Wilkinson, resistive, or reactive power combiner circuitry) that is configured to combine respective signals that are received from respective RF signal RF signal outputs 112*a* through 112*n*, and to output a resulting combined RF signal via combined RF signal output 820, e.g., to any type of active or passive RF circuitry. Although a power combiner is illustrated in FIG. 8, it will be understood that a RF signal distribution network apparatus may be provided in another exemplary embodiment of the disclosed systems and methods in the form of a signal divider.

Figure 8B:
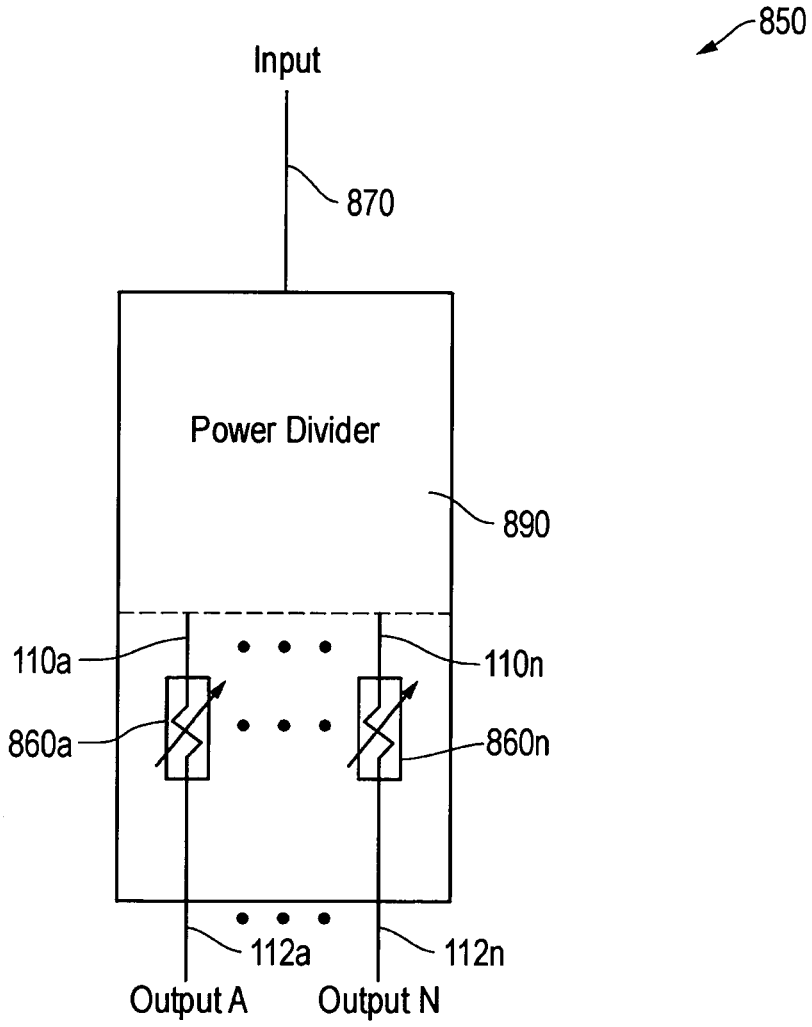
FIG. 8B is a simplified block diagram of a RF signal distribution network apparatus according to one exemplary embodiment of the disclosed apparatus and methods.

FIG. 8B is a block diagram of a RF signal distribution network apparatus 850 according to one exemplary embodiment that includes two or more phase tuners 860*a* through 860*n* that each include an electrical conductor (e.g., microstrip transmission line 104 or stripline transmission line 105) disposed in spaced relationship to an electrically conductive ground plane with dielectric material disposed therebetween and with a spacing between the electrical conductor and at least a portion of the electrically conductive ground plane being adjustable to vary the phase delay of a RF signal communicated by the electrical conductor in a manner as described elsewhere herein, e.g., such as in relation to the embodiments of FIGS. 1-7. As shown in FIG. 8B, RF signal distribution network apparatus 850 includes a single signal input 870 that may be coupled to receive a RF signal, e.g., from an antenna apparatus, that is divided by power divider 890 into a separate RF signal input 110 corresponding to each of phase tuners 860*a* to 860*n*. Each of phase tuners 860 in turn includes a respective RF signal output 112.

In the practice of the disclosed systems and methods, a signal transmission apparatus 100 may be configured with one or more adjustable members that are configured in similar fashion to adjustable conductive members 122 of the embodiments of FIGS. 1-7 (or other suitable configuration), and in which the orientation of electromagnetic field lines around an electrical conductor during signal transmission may be perturbed or otherwise varied by positioning of an adjustable member 122 at different distances from an electrical conductor when an adjustable member 122 comprises a material that is effective to so vary the orientation of electromagnetic field lines around the electrical conductor. This variance of the electromagnetic field lines causes a variation in phase delay of the signal being transmitted by the electrical conductor such that a phase delay of a RF signal communicated by an electrical conductor when the adjustable member is disposed at a first distance relative to the electrical conductor is different than a phase delay of the same RF signal communicated by the same electrical conductor when the same adjustable member is disposed at a second distance relative to the electrical conductor that is different than the first distance.

In this regard, any material suitable for so varying the electromagnetic field of a signal may be evaluated and selected for use as an adjustable member 122 in the practice of the disclosed systems and methods. Examples of such suitable materials include, but are not limited to, electrically conductive materials that are electrically coupled to a ground plane in a manner suitable for varying the phase delay of a signal as described above for the embodiments of FIGS. 1-7, electrically conductive or non-electrically conductive materials having a dielectric constant that is different than the dielectric material 103 in order to vary the phase delay of a signal communicated by the electrical conductor, electrically conductive or non-electrically conductive magnetic materials, etc.

Examples of adjustable member materials having a dielectric constant that is greater than a PCB material selected for use as a dielectric material 103 include, but are not limited to, relatively insulative materials including ceramics, etc. In one exemplary embodiment, a dielectric material 103 may have a dielectric constant of from about 2to about 4, and an adjustable member 122 may have a relatively higher dielectric constant of from about 8to about 12. However, it will be understood that dielectric materials having a dielectric constant less than about 2or greater than about 4, and/or adjustable members having dielectric constant of less than about 8or greater than about 12, are also possible. Examples of an adjustable member that is composed of a magnetic material suitable for varying an electromagnetic field around an electrical conductor during signal transmission include, but are not limited to, magnetic radar absorbing materials (MAGRAM) to perturb the electro-magnetic field. One specific example of such a MAGRAM material is an iron-loaded silicone material.

Although certain embodiments have been illustrated herein, it will be understood that a signal transmission apparatus of the disclosed systems and methods may be implemented in any configuration suitable for providing an electrical conductor disposed in spaced relationship to an electrically conductive ground plane with a dielectric material disposed therebetween, and having at least one adjustable member configured to be adjustable between at least two positions that are each spaced apart from the electrical conductor so that the material of the adjustable member is effective to vary an electromagnetic field of a signal communicated by the electrical conductor to vary the phase delay of the communicated signal.

Figure 9:
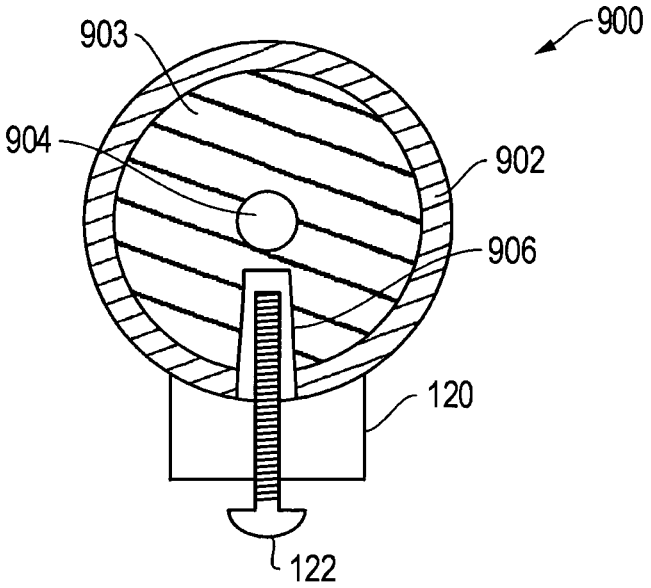
FIG. 9 is a side cross-sectional view of a RF signal transmission circuit apparatus according to one exemplary embodiment of the disclosed apparatus and methods.

For example, FIG. 9 illustrates another exemplary embodiment of a signal transmission circuit apparatus 900, in this case configured with a coaxial geometry having a longitudinal axis that is shown oriented perpendicular to, and extending into and out of the page in FIG. 9. As shown, signal transmission circuit apparatus 900 of this embodiment includes a substantially cylindrical electrically conductive ground plane 902 that surrounds an elongated electrical conductor 904 with dielectric material 903 disposed in the annulus formed therebetween. Opening 906 is provided as shown to extend through electrically conductive ground plane 902 and into annular dielectric material 903 in a direction perpendicular to the longitudinal axis of signal transmission circuit apparatus 900. Opening 906 so extends to a position adjacent and substantially centered along the longitudinal axis of electrical conductor 904. Opening 906 is shown further provided with an electrically conductive internally threaded stand-off or collar 120 configured to receive a corresponding adjustable conductive member provided in the form of a threaded screw 122 that is complementary threaded to match the internal threads of threaded collar 920 in a similar manner as previously described herein. In this way, threaded screw 122 is adjustable between multiple positions of varying distance from elongated electrical conductor 904. It is possible that transmission circuit apparatus 900 may be so provided with adjustable conductive members that are aligned along the longitudinal axis of transmission circuit apparatus 900, and/or that a system may be provided with more than one transmission circuit apparatus 900, e.g., disposed in adjacent parallel relationship.

It will be understood that the disclosed systems and methods may be implemented to provide phase tuning (e.g., phase matching) for a variety of types of circuits and networks (e.g., RF circuits and RF networks) to provide required phase tuning or otherwise to provide signal handling performance. Examples of such circuit types include, but are not limited to, individual circuits such as power combiners (e.g., for phase matching two or more signal inputs for optimum signal summation), power splitters (e.g., for phase matching two or more outputs for optimum coherent (in-phase) signal distribution), couplers (e.g., for tuning for optimum performance), filters (e.g., for tuning for optimum performance), transmission line tuning for phase matching (e.g., stripline, microstrip, coax, etc.). Examples of such network types include, but are not limited to, networks including two or more individual circuits that require or that may otherwise be implemented with phase matching including, but not limited to, a RF boresight distribution network for a direction finding (DF) interferometer system, a RF beamforming network for a phased array antenna, etc.

EXAMPLE

The following example is illustrative and should not be construed as limiting the scope of the invention or claims thereof.

A prototype board was built on Arlon RF board material (available from Arlon of Rancho Cucamonga, Calif.) using a Protomat X60 (available from LPKF Laser and Electronics of Wilsonville, Oreg.) according to a layout similar to that illustrated in FIGS. 1-4. The dielectric material 103 of the board was 62 mils thick and had 1 ounce copper cladding on the front and back. The dielectric constant of the dielectric material 103 was 2.45. Eight 50 ohm transmission lines 104 were routed into the front copper cladding of the board, with the copper cladding on the back serving as ground plane 102. All lines 104 were of the same width (0.171 inches) and length (3.0 inches). One of the lines 104*a* was used as a reference with no holes routed adjacent thereto. Two of the lines 104*b* and 104*c* each had a single #4 hole 106 routed on the back of the board adjacent each line, two of the lines 104*d* and 104*e* each had a single #6 hole 106 routed on the back of the board adjacent each line, and three lines 104*f*, 104*g* and 104*h* each had both a #4 and #6 hole 106 routed on the back of the board adjacent each line. All holes 106 were centered on the longitudinal axis of the line 104 to which it was adjacent. Both #4 and #6 screws and nuts were attached to the back of the board directly over holes that extended approximately 57 mils into the dielectric material from the back of the board in a manner similar to that illustrated herein for internally threaded collars 120 and threaded screws 122. Each screw was grounded through a nut soldered to the ground plane copper cladding 102 on the back of the board.

In this example, two of the 50 ohm microstrip lines 104 were tested between 450 and 2700 MHz. A first one of the lines 104 had one #4 screw which could be adjusted to obtain from 0 degree phase adjustment at 2700 MHz (screw all the way out and spaced 57 mil from the transmission line 104) to −2.7 degrees of phase adjustment at 2700 MHz (screw partially in and spaced 15 mil from the transmission line 104). An added insertion loss of only 0.05 dB at 2.7 GHz was also measured with the screw screws all the way in.

In this example, voltage standing wave ratio (VSWR) was also measured for the first one of the transmission lines 104 of this example with its single #4 screw all the way in (screw spaced 15 mil from the transmission line 104) and all the way out (screw spaced 57 mil from the transmission line 104). The VSWR was observed to increase slightly from 1.016:1 to 1.180:1 at 2.7 GHz when the screw was all the way in and closest to the line 104 versus all the way out and farthest from the line 104.

A second one of the lines 104 had two screws (a #4 and a #6 screw) which could be adjusted to obtain 0 degrees of phase adjustment at 2700 MHz (screws all the way out and spaced 57 mil from the transmission line 104) to −9 degrees of phase adjustment at 2700 MHz (screws all the way in and spaced 5 mil from the transmission line 104). An added insertion loss of only 0.02 dB at 2.7 GHz was also measured with both screws all the way in.

Thus, this example illustrates how the depth of the screws in relation to the microstrip RF transmission lines may be adjusted to gain additional phase delay by decreasing the ground plane spacing, in a small area relative to wavelength and between the trace and ground plane, in a microstrip transmission line.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed systems and methods may be utilized in various combinations and/or independently. Thus the invention is not limited to only those combinations shown herein, but rather may include other combinations.

What is claimed is:

1. A signal distribution network apparatus, comprising:

at least one electrically conductive ground plane;

a dielectric material disposed adjacent said at least one electrically conductive ground plane;

two or more electrical conductors disposed in spaced relationship to said at least one electrically conductive ground plane with said dielectric material disposed therebetween, each of said two or more electrical conductors having a signal input and a signal output, each given one of said two or more electrical conductors being disposed in spaced relationship to said at least one electrically conductive ground plane at a position between said signal input and said signal output of said given one of said two or more electrical conductors; and at least one adjustable conductive member corresponding to each given one of said two or more electrical conductors, each of said at least one adjustable conductive members being disposed adjacent said corresponding given one of said two or more electrical conductors at a point between said signal input and said signal output of said two or more electrical conductors, and disposed closer to a corresponding given one of said two or more electrical conductors than it is disposed to any other of said two or more electrical conductors;

wherein each of said at least one adjustable conductive members is disposed in electrical contact with said at least one electrically conductive ground plane;

wherein each of said at least one adjustable conductive members is configured to be adjustable between at least two positions that are each spaced apart from said corresponding given one of said two or more electrical conductors, said at least one adjustable conductive member being closer in distance to said corresponding given one of said electrical conductors when disposed in a first one of said at least two positions than when disposed in a second one of said at least two positions;

wherein a phase delay of a signal communicated by each given one of said two or more electrical conductors when said at least one adjustable conductive member corresponding to said given one of said two or more electrical conductors is disposed in said first one of said at least two positions is different than a phase delay of the same signal communicated by said same given one of said two or more electrical conductors when said at least one adjustable conductive member corresponding to said given one of said two or more electrical conductors is disposed in said second one of said at least two positions; and wherein said signal outputs of said two or more electrical conductors are electrically coupled together to combine signals communicated by said two or more electrical conductors, or wherein said respective signal inputs of said two or more electrical conductors are electrically coupled together to divide an incoming signal into a first signal provided at said input of said first one of said two or more electrical conductors and a second signal provided at said input of said second one of said two or more electrical conductors.

2. The apparatus of claim 1, wherein each of said two or more electrical conductors is configured as an elongated strip of conductive material having a longitudinal axis; and wherein each of said at least one adjustable conductive members is disposed adjacent said electrical conductor at a position along said longitudinal axis of said elongated strip of conductive material; and wherein each of said at least one adjustable conductive members is configured to adjustably extend from said at least one electrically conductive ground plane toward a corresponding given one of said two or more electrical conductors to adjust said adjustable conductive member from said second one to said first one of said at least two positions.

3. The apparatus of claim 2, wherein each of said at least one adjustable conductive members comprises a threaded member received in a complementary internally threaded opening and extending through said at least one electrically conductive ground plane toward a corresponding given one of said two or more electrical conductors; and wherein each of said at least one adjustable conductive members is configured to be threadably adjusted to extend from said at least one electrically conductive ground plane toward a corresponding given one of said two or more electrical conductors to adjust said adjustable conductive member from said second one to said first one of said at least two positions.

4. The apparatus of claim 1, wherein a first side of said dielectric material is oriented to face a first side of said at least one electrically conductive ground plane; wherein a second side of said dielectric materials is oriented to face away from said first side of said at least one electrically conductive ground plane; wherein said apparatus further comprises a conductive enclosure that at least partially surrounds said at least one electrically conductive ground plane, said dielectric material and said two or more electrical conductors; and wherein said conductive enclosure comprises:

an electrically conductive base component in electrical contact with a second side of said at least one electrically conductive ground plane that faces away from said first side of said electrically conductive ground plane;

an electrically conductive lid component disposed in spaced relationship with said second side of said dielectric material to form a cavity therebetween; and at least one electrically conductive side component extending between said electrically conductive base component and said electrically conductive lid component, said electrically conductive side component being in electrical contact with each of said electrically conductive base component and said electrically conductive lid component; and wherein said each of said at least one adjustable conductive members is configured to adjustably extend from said electrically conductive lid component toward a corresponding given one of said two or more electrical conductors to said first one of said at least two positions.

5. The apparatus of claim 4, wherein said conductive enclosure and said at least one adjustable conductive member are sealed together so that said cavity provides a hermetically sealed environment for said two or more electrical conductors.

6. the apparatus of claim 4, wherein said signal comprises a radio frequency (RF) signal.

7. The apparatus of claim 1, wherein each of said at least one adjustable conductive member comprises at least two adjustable conductive members disposed adjacent said electrical conductor at two different positions along said longitudinal axis of corresponding given one of said elongated strips of conductive material.

8. The apparatus of claim 1, wherein said signal comprises a radio frequency (RF) signal.

9. A method of combining signals in a signal distribution network apparatus, comprising:

providing a signal distribution network apparatus that comprises:

at least one electrically conductive ground plane, a dielectric material disposed adjacent said at least one electrically conductive ground plane, two or more electrical conductors disposed in spaced relationship to said at least one electrically conductive ground plane with said dielectric material disposed therebetween, each of said two or more electrical conductors having a signal input and a signal output, each given one of said two or more electrical conductors being disposed in spaced relationship to said at least one electrically conductive ground plane at a position between said signal input and said signal output of said given one of said two or more electrical conductors, at least one first adjustable conductive member corresponding to a first one of said two or more electrical conductors, said at least one first adjustable conductive member being disposed adjacent said first one of said two or more electrical conductors at a point between said signal input and said signal output of said first one of said two or more electrical conductors and being disposed closer to said first one of said two or more electrical conductors than it is disposed to any other of said two or more electrical conductors, and at least one second adjustable conductive member corresponding to a second one of said two or more electrical conductors, said at least one second adjustable conductive member being disposed adjacent said second one of said two or more electrical conductors at a point between said signal input and said signal output of said second one of said two or more electrical conductors and being disposed closer to said second one of said two or more electrical conductors than it is disposed to any other of said two or more electrical conductors, wherein each of said at least one adjustable conductive members is disposed in electrical contact with said at least one electrically conductive ground plane;

providing a first signal at an input of said first one of said two or more electrical conductors such that said first signal is communicated through said first one of said two or more electrical conductors to an output of said second of said two or more electrical conductors;

providing a second signal at an input of a second one of said two or more electrical conductors such that said second signal is communicated through said second one of said two or more electrical conductors to an output of said second of said two or more electrical conductors;

adjusting said at least one first adjustable conductive member between at least two positions that are each spaced apart from said first one of said two or more electrical conductors while said first signal is being communicated through said first electrical conductor, said at least one first adjustable conductive member being closer in distance to said first one of said two or more electrical conductors when disposed in a first one of said at least two positions than when disposed in a second one of said at least two positions, and such that a phase delay of said first signal being communicated by said first one of said two or more electrical conductors when said at least one first adjustable conductive member is disposed in said first one of said at least two positions is different than a phase delay of said first signal when said at least one first adjustable conductive member is disposed in said second one of said at least two positions;

adjusting said at least one second adjustable conductive member between at least two positions that are each spaced apart from said second one of said two or more electrical conductors while said second signal is being communicated through said second electrical conductor, said at least one second adjustable conductive member being closer in distance to said second one of said two or more electrical conductors when disposed in a first one of said at least two positions than when disposed in a second one of said at least two positions, and such that a phase delay of said second signal being communicated by said second one of said two or more electrical conductors when said at least one second adjustable conductive member is disposed in said first one of said at least two positions is different than a phase delay of said second signal when said at least one second adjustable conductive member is disposed in said second one of said at least two positions; and combining said first signal received from said output of said first one of said two or more electrical conductors with said second signal received from said second one of said two or more electrical conductors, or dividing an incoming signal into said first and second signals prior to providing said first signal at said input of said first one of said two or more electrical conductors and prior to providing said second signal at said input of said second one of said two or more electrical conductors.

10. The method of claim 9, wherein said first one of said two or more electrical conductors is configured as a first elongated strip of conductive material having a longitudinal axis and said at least one first adjustable conductive member is disposed adjacent said first one of said two or more electrical conductors at a position along said longitudinal axis of said first elongated strip of conductive material; wherein said second one of said two or more electrical conductors is configured as a second elongated strip of conductive material having a longitudinal axis and said at least one second adjustable conductive member is disposed adjacent said second one of said two or more electrical conductors at a position along said longitudinal axis of said second elongated strip of conductive material; and wherein said method further comprises:

extending said at least first adjustable conductive member from said at least one electrically conductive ground plane toward said first one of said two or more electrical conductors to adjust said first adjustable conductive member from said second one to said first one of said at least two positions; and extending said at least second adjustable conductive member from said at least one electrically conductive ground plane toward said second one of said two or more electrical conductors to adjust said second adjustable conductive member from said second one to said first one of said at least two positions.

11. The method of claim 10, wherein said first adjustable conductive member comprises a first threaded member received in a complementary first threaded opening and extending through said at least one electrically conductive ground plane toward a said first one of said two or more electrical conductors; wherein said second adjustable conductive member comprises a second threaded member received in a complementary second threaded opening and extending through said at least one electrically conductive ground plane toward a said second one of said two or more electrical conductors; and wherein said method further comprises:

rotating said first threaded member within said complementary first threaded opening to extend said first adjustable conductive member from said at least one electrically conductive ground plane toward said first one of said two or more electrical conductors to adjust said first adjustable conductive member from said second one to said first one of said at least two positions; and rotating said second threaded member within said complementary second threaded opening to extend said second adjustable conductive member from said at least one electrically conductive ground plane toward said second one of said two or more electrical conductors to adjust said second adjustable conductive member from said second one to said first one of said at least two positions.

12. The method of claim 9, wherein said signal comprises a radio frequency (RF) signal.

13. A signal transmission circuit apparatus, comprising:

a first electrically conductive ground plane;

a dielectric material disposed adjacent said first electrically conductive ground plane; and an electrical conductor disposed in spaced relationship to said first electrically conductive ground plane with said dielectric material disposed therebetween;

wherein a spacing between said electrical conductor and at least a portion of said first electrically conductive ground plane is adjustable to vary the phase delay of a signal communicated by said electrical conductor:

wherein said electrical conductor is an exposed electrical conductor that is disposed on an exposed surface of said dielectric material.

14. The apparatus of claim 13, further comprising at least one adjustable conductive member in electrical contact with said first electrically conductive ground plane; wherein said at least one adjustable conductive member is configured to be adjustable between at least two positions that are each spaced apart from said electrical conductor, said at least one adjustable conductive member being closer in distance to said electrical conductor when disposed in a first one of said at least two positions than when disposed in a second one of said at least two positions; and wherein a phase delay of a signal communicated by said electrical conductor when said at least one adjustable conductive member is disposed in said first one of said at least two positions is different than a phase delay of the same signal communicated by said electrical conductor when said at least one adjustable conductive member is disposed in said second one of said at least two positions.

15. The apparatus of claim 14, wherein said at least one adjustable conductive member is configured to adjustably extend from said first electrically conductive ground plane toward said electrical conductor to adjust said adjustable conductive member from said second one to said first one of said at least two positions.

16. The apparatus of claim 15, wherein said at least one adjustable conductive member comprises a threaded member received in a complementary internally threaded opening and extending through said first electrically conductive ground plane toward said electrical conductor; and wherein said at least one adjustable conductive member is configured to be threadably adjusted to extend from said first electrically conductive ground plane toward said electrical conductor to adjust said adjustable conductive member from said second one to said first one of said at least two positions.

17. The apparatus of claim 14, wherein a first side of said dielectric material is oriented to face said first electrically conductive ground plane; wherein a second side of said dielectric material is oriented to face away from said first electrically conductive ground plane; wherein said first side of said dielectric material is in contact with said first electrically conductive ground plane; and wherein said exposed electrical conductor is disposed on an exposed surface of said second side of said dielectric material.

18. The apparatus of claim 14, wherein said electrical conductor is configured as an elongated strip of conductive material having a longitudinal axis; and wherein said at least one adjustable conductive member comprises at least two adjustable conductive members disposed adjacent said electrical conductor at two different positions along said longitudinal axis of said elongated strip of conductive material.

19. The apparatus of claim 13, wherein said signal comprises a radio frequency (RF) signal.

20. A signal transmission circuit apparatus, comprising:

a first electrically conductive ground plane;

a dielectric material disposed adjacent said first electrically conductive ground plane; and an electrical conductor disposed in spaced relationship to said first electrically conductive ground plane with said dielectric material disposed therebetween;

wherein a spacing between said electrical conductor and at least a portion of said first electrically conductive ground plane is adjustable to vary the phase delay of a signal communicated by said electrical conductor;

where the signal transmission circuit apparatus further comprises at least one adjustable conductive member in electrical contact with said first electrically conductive ground plane; wherein said at least one adjustable conductive member is configured to be adjustable between at least two positions that are each spaced apart from said electrical conductor, said at least one adjustable conductive member being closer in distance to said electrical conductor when disposed in a first one of said at least two positions than when disposed in a second one of said at least two positions; and wherein a phase delay of a signal communicated by said electrical conductor when said at least one adjustable conductive member is disposed in said first one of said at least two positions is different than a phase delay of the same signal communicated by said electrical conductor when said at least one adjustable conductive member is disposed in said second one of said at least two positions; and wherein a first side of said dielectric material is oriented to face said first electrically conductive ground plane; wherein a second side of said dielectric material is oriented to face away from said first electrically conductive ground plane; and wherein said apparatus further comprises:

a supporting member disposed in spaced relationship with said second side of said dielectric material, and wherein said at least one adjustable conductive member is configured to adjustably extend from said support member toward said electrical conductor to adjust said adjustable conductive member from said second one to said first one of said at least two positions.

21. A signal transmission circuit apparatus, comprising:

a first electrically conductive ground plane;

a dielectric material disposed adjacent said first electrically conductive ground plane; and an electrical conductor disposed in spaced relationship to said first electrically conductive ground plane with said dielectric material disposed therebetween;

wherein a spacing between said electrical conductor and at least a portion of said first electrically conductive ground plane is adjustable to vary the phase delay of a signal communicated by said electrical conductor;

where the signal transmission circuit apparatus further comprises at least one adjustable conductive member in electrical contact with said first electrically conductive ground plane; wherein said at least one adjustable conductive member is configured to be adjustable between at least two positions that are each spaced apart from said electrical conductor, said at least one adjustable conductive member being closer in distance to said electrical conductor when disposed in a first one of said at least two positions than when disposed in a second one of said at least two positions; and wherein a phase delay of a signal communicated by said electrical conductor when said at least one adjustable conductive member is disposed in said first one of said at least two positions is different than a phase delay of the same signal communicated by said electrical conductor when said at least one adjustable conductive member is disposed in said second one of said at least two positions; and wherein a first side of said dielectric material is oriented to face a first side of said first electrically conductive ground plane; wherein a second side of said dielectric material is oriented to face away from said first side of said first electrically conductive ground plane; wherein said apparatus further comprises a conductive enclosure that at least partially surrounds said first electrically conductive ground plane, said dielectric material and said electrical conductor; and wherein said conductive enclosure comprises:

an electrically conductive base component in electrical contact with a second side of said first electrically conductive ground plane that faces away from said first side of said electrically conductive ground plane, an electrically conductive lid component disposed in spaced relationship with said second side of said dielectric material to form a cavity therebetween, at least one electrically conductive side component extending between said electrically conductive base component and said electrically conductive lid component, said electrically conductive side component being in electrical contact with each of said electrically conductive base component and said electrically conductive lid component, and wherein said at least one adjustable conductive member is configured to adjustably extend from said electrically conductive lid component toward said electrical conductor to adjust said adjustable conductive member from said second one to said first one of said at least two positions.

22. The apparatus of claim 21, wherein said conductive enclosure and said at least one adjustable conductive member are sealed together so that said cavity provides a hermetically sealed environment for said electrical conductor.

23. The apparatus of claim 21, wherein said electrical conductor is an exposed electrical conductor that is disposed on said second side of said dielectric material.

24. A method of adjusting a phase delay of a signal, comprising:

providing a signal transmission circuit apparatus that comprises:

at least one electrically conductive ground plane, a dielectric material disposed adjacent said at least one electrically conductive ground plane, and an electrical conductor disposed in spaced relationship to said at least one electrically conductive ground plane with said dielectric material disposed therebetween, said electrical conductor having a signal input and a signal output, and said electrical conductor being disposed in spaced relationship to said at least one electrically conductive ground plane at a position between said signal input and said signal output, wherein a spacing between said electrical conductor and at least a portion of said at least one electrically conductive ground plane is adjustable, wherein said electrical conductor is an exposed electrical conductor that is disposed on an exposed surface of said dielectric material;

providing a signal at said input of said electrical conductor such that said signal is communicated through said electrical conductor to said output of said electrical conductor; and adjusting a spacing between said electrical conductor and at least a portion of said first electrically conductive ground plane to vary the phase delay of said signal communicated by said electrical conductor.

25. The method of claim 24, further comprising:

providing said signal transmission circuit with at least one adjustable conductive member in electrical contact with said at least one electrically conductive ground plane and being disposed adjacent said electrical conductor at a point between said signal input and said signal output of said electrical conductor; and adjusting said adjustable conductive member between at least two positions that are each spaced apart from said electrical conductor while said signal is being communicated through said electrical conductor, said at least one adjustable conductive member being closer in distance to said electrical conductor when disposed in a first one of said at least two positions than when disposed in a second one of said at least two positions, and such that a phase delay of said signal being communicated by said electrical conductor when said at least one adjustable conductive member is disposed in said first one of said at least two positions is different than a phase delay of said signal when said at least one adjustable conductive member is disposed in said second one of said at least two positions.

26. The method of claim 25, further comprising extending said adjustable conductive member from said at least one electrically conductive ground plane toward said electrical conductor to adjust said adjustable conductive member from said second one to said first one of said at least two positions.

27. The method of claim 26, wherein said at least one adjustable conductive member comprises a threaded member received in a complementary internally threaded opening and extending through said at least one electrically conductive ground plane toward said electrical conductor; and wherein said method further comprises rotating said threaded member within said complementary internally threaded opening to extend said adjustable conductive member from said at least one electrically conductive ground plane toward said electrical conductor to adjust said adjustable conductive member from said second one to said first one of said at least two positions.

28. The method of claim 24, wherein said signal comprises a radio frequency (RF) signal.

29. A signal transmission circuit apparatus, comprising:

a first electrically conductive ground plane;

a dielectric material disposed adjacent said first electrically conductive ground plane;

an electrical conductor disposed in spaced relationship to said first electrically conductive ground plane with said dielectric material disposed therebetween; and at least one adjustable member configured to be adjustable between at least two positions that are each spaced apart from said electrical conductor, said at least one adjustable member being closer in distance to said electrical conductor when disposed in a first one of said at least two positions than when disposed in a second one of said at least two positions;

wherein said adjustable member comprises a material effective to vary an electromagnetic field of a signal communicated by said electrical conductor when said at least one adjustable member is disposed in said first one of said at least two positions such that a phase delay of said signal communicated by said electrical conductor when said at least one adjustable member is disposed in said first one of said at least two positions is different than a phase delay of the same signal communicated by said electrical conductor when said at least one adjustable member is disposed in said second one of said at least two positions.

30. The apparatus of claim 29, wherein said adjustable member comprises a material having a dielectric constant that is different than a dielectric constant of said dielectric material disposed adjacent said first electrically conductive ground plane, wherein said adjustable member is electrically coupled to said at least one electrically conductive ground plane, wherein said adjustable member comprises a magnetic material, or a combination thereof.

31. The apparatus of claim 29, wherein said signal comprises a radio frequency (RF) signal.

32. A method of adjusting a phase delay of a signal, comprising:

providing a signal transmission circuit apparatus that comprises:

at least one electrically conductive ground plane, a dielectric material disposed adjacent said at least one electrically conductive ground plane, an electrical conductor disposed in spaced relationship to said at least one electrically conductive ground plane with said dielectric material disposed therebetween, said electrical conductor having a signal input and a signal output, and said electrical conductor being disposed in spaced relationship to said at least one electrically conductive ground plane at a position between said signal input and said signal output, and at least one adjustable member in electrical contact with said at least one electrically conductive ground plane and being disposed adjacent said electrical conductor at a point between said signal input and said signal output of said electrical conductor, said adjustable member comprising a material effective to vary an electromagnetic field of a signal communicated by said electrical conductor when disposed adjacent said electrical conductor;

providing a signal at said input of said electrical conductor such that said signal is communicated through said electrical conductor to said output of said electrical conductor; and adjusting said adjustable member between at least two positions that are each spaced apart from said electrical conductor while said signal is being communicated through said electrical conductor to vary an electromagnetic field of said signal communicated by said electrical conductor, said at least one adjustable member being closer in distance to said electrical conductor when disposed in a first one of said at least two positions than when disposed in a second one of said at least two positions, and such that a phase delay of said signal being communicated by said electrical conductor when said at least one adjustable member is disposed in said first one of said at least two positions is different than a phase delay of said signal when said at least one adjustable member is disposed in said second one of said at least two positions.

33. The method of claim 32, wherein said adjustable member comprises a material having a dielectric constant that is different than a dielectric constant of said dielectric material disposed adjacent said first electrically conductive ground plane, wherein said adjustable member is electrically coupled to said at least one electrically conductive ground plane, wherein said adjustable member comprises a magnetic material, or a combination thereof.

34. The method of claim 32, wherein said signal comprises a radio frequency (RF) signal.

* * * * *